US009461376B1

(12) United States Patent
Bakhoum

(10) Patent No.: US 9,461,376 B1
(45) Date of Patent: Oct. 4, 2016

(54) VEHICULAR BATTERY JUMPER CLAMP WITH LARGE CONTACT SURFACE AREA

(71) Applicant: Ezzat G. Bakhoum, Milton, FL (US)

(72) Inventor: Ezzat G. Bakhoum, Milton, FL (US)

( * ) Notice: Subject to any disclaimer, the term of this patent is extended or adjusted under 35 U.S.C. 154(b) by 0 days.

(21) Appl. No.: 14/848,238

(22) Filed: Sep. 8, 2015

(51) Int. Cl.
*H01R 4/48* (2006.01)
*H01R 11/28* (2006.01)
*H01R 11/24* (2006.01)

(52) U.S. Cl.
CPC ..... *H01R 11/286* (2013.01); *H01R 11/24* (2013.01); *H01R 11/281* (2013.01)

(58) Field of Classification Search
CPC ..... H01R 11/24; H01R 11/281; H01R 11/22; H01R 11/287; H01R 11/288
USPC ..... 439/759, 504, 506, 822, 829, 726, 755
See application file for complete search history.

(56) References Cited

U.S. PATENT DOCUMENTS 4,042,759 A * 8/1977 Cella ..... H01R 11/281 429/121
4,345,807 A * 8/1982 Shekel ..... H01R 11/24 439/174
4,377,317 A * 3/1983 Shekel ..... H01R 11/24 429/121
4,565,414 A * 1/1986 French ..... H01R 11/24 439/241
4,620,767 A * 11/1986 Woolf ..... H01R 11/24 439/217
4,759,728 A 7/1988 Cobb
4,869,688 A 9/1989 Merio
4,897,044 A 1/1990 Rood
4,923,415 A * 5/1990 Lee ..... H01R 11/24 439/504
4,934,957 A 6/1990 Bellusci
4,975,089 A * 12/1990 Lee ..... H01R 11/24 439/504
5,030,106 A 7/1991 Cameron et al.
5,037,335 A 8/1991 Campbell
5,071,368 A 12/1991 Garritano et al.
5,435,759 A 7/1995 Adams
5,601,452 A 2/1997 Ruffa
5,662,504 A * 9/1997 Krivec ..... H01R 11/287 439/755
6,254,438 B1 * 7/2001 Gaunt ..... H01R 11/287 439/755
6,783,404 B1 8/2004 Shammout
8,277,246 B2 * 10/2012 Naskali ..... H01R 31/065 429/121
8,465,594 B1 6/2013 Harder
2001/0012738 A1 8/2001 Duperret et al.
2007/0287326 A1 * 12/2007 Grippe ..... H01R 4/5033 439/504

* cited by examiner

*Primary Examiner* — Neil Abrams
*Assistant Examiner* — Travis Chambers

(57) ABSTRACT

The invention is a novel clamp for a car battery jumper. The main deficiency in the various clamps used in car battery jumpers is the very small contact surface area, which chokes off the electric current and makes the task of starting the vehicle very difficult. The new clamp disclosed herein features a longitudinal structure consisting of a spring and a metal disk. Upon gripping the terminal of a battery, the metal disk included in the clamp comes into contact with the top surface of the battery's terminal, thus insuring a large contact surface area and hence a substantially better starting current.

13 Claims, 3 Drawing Sheets

VEHICULAR BATTERY JUMPER CLAMP WITH LARGE CONTACT SURFACE AREA

BACKGROUND OF THE INVENTION

1. Field of the Invention

The present invention is a novel clamp for a car battery jumper. Commercially available car battery jumpers typically feature two cables and four clamps for connecting the batteries of two different vehicles to each other. Each clamp typically features two jaws for strongly gripping the terminal of a battery regardless of its shape. The main problem with commercially available clamps is that the contact area provided by the jaws is very small. Unfortunately, such a small contact area creates a very large electrical resistance that chokes off the current and makes the task of starting a vehicle very difficult.

2. Background Art

Improvements to the basic battery clamp can be found in the patent literature. U.S. Pat. No. 8,465,594 issued to Harder shows a clamp with improved jaws, where the jaws of the clamp are equipped with metal brushes for providing a larger contact surface area. The Harder patent, however, will not be a good solution if the terminal of the battery has a lug or another irregularly-shaped structure attached to it, which is usually the case. US Patent Application No. 2001/0012738 A1, by Duperret et al., shows another solution where the jaws of the clamp are equipped with more teeth for providing an improved surface area. The improvement, however, only provides a minimal increase in the area of contact with the battery's terminal.

BRIEF SUMMARY OF THE INVENTION

The present invention is a new, novel clamp for a car battery jumper. As indicated above, the main deficiency in the various clamps used in car battery jumpers is the very small contact surface area, which chokes off the electric current and makes the task of starting the vehicle very difficult. The new clamp disclosed herein features a longitudinal structure consisting of a spring and a metal disk. Upon gripping the terminal of a battery, the metal disk included in the clamp comes into contact with the top surface of the battery's terminal, thus insuring a large contact surface area and hence a substantially better starting current.

DETAILED DESCRIPTION OF THE INVENTION

Figure 1:
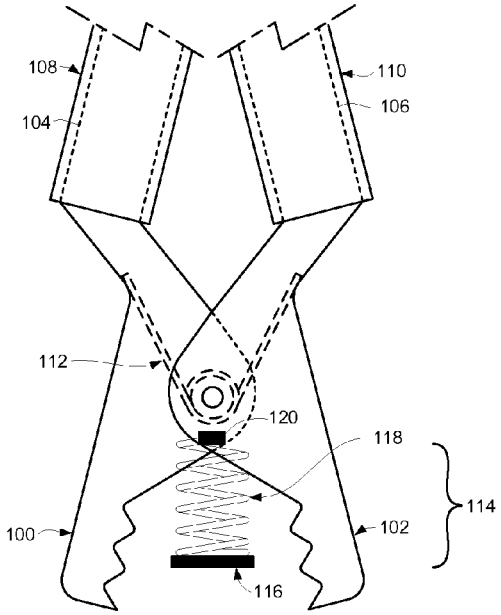
FIG. 1 is a sketch of the preferred embodiment of the present invention. The figure shows a battery clamp featuring two jaws as known in the prior art. In between the jaws a longitudinal structure consisting of a spring and a metal disk is positioned and is electrically attached to the body of the clamp.

The present invention is an improvement that provides a very substantial increase in the contact area between the clamp and the terminal of any conventional car battery, thus insuring a much lower electrical resistance and hence a substantially better starting current. Reference is now made to the drawings. FIG. 1 shows a battery clamp that consists of two metal jaws 100 and 102, two arms 104 and 106, two plastic arm covers 108 and 110, and one butterfly-shaped spring 112 for forcing the jaws of the clamp toward each other. This structure is well known in the prior art. The new invention is the longitudinal conductive member 114, which consists of two components: a metal disk 116 and a straight spring 118. The spring 118 is attached inside the body of the clamp by means of a small plate 120 that is fixed in place.

Figure 2:
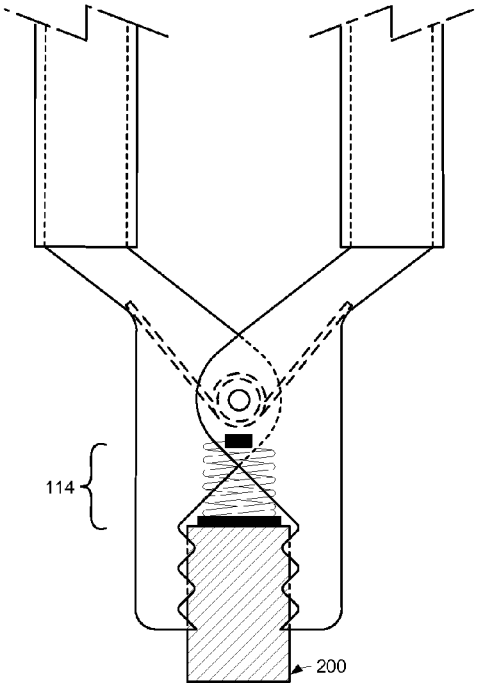
FIG. 2 is a sketch of the same invention shown in FIG. 1, where the jaws are shown gripping the terminal of a car battery. The longitudinal structure is in contact with the top surface of the terminal, and is compressed after the terminal is inserted in between the jaws.

FIG. 2 shows the entire structure after the insertion of a battery terminal 200 in between the jaws of the clamp. The metal disk 116 will come in contact with the top surface of the battery terminal, and the spring 118 will be compressed, as shown; and hence the longitudinal member 114 will be insuring a very good electrical contact with the surface of the battery terminal.

Figure 3:
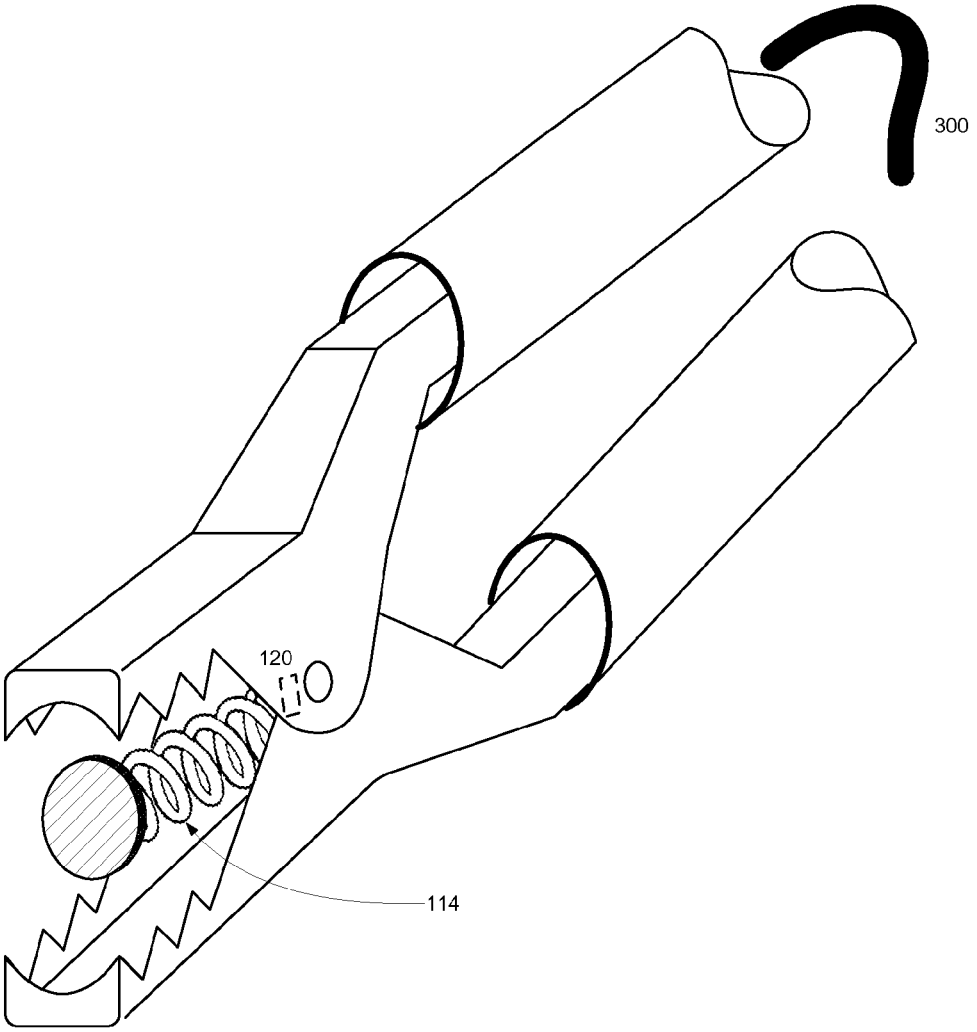
FIG. 3 is an isometric view of the invention.

FIG. 3 is an isometric view of the invention, and the longitudinal member 114 can be clearly seen in the figure. The small plate 120 is shown as a dotted line because, in practice, it will be rigidly attached inside the body of the clamp and will not be visible from the outside. The figure also shows a cable 300, which is usually soldered or rigidly attached to the clamp through one of the arms.

Figure 4:
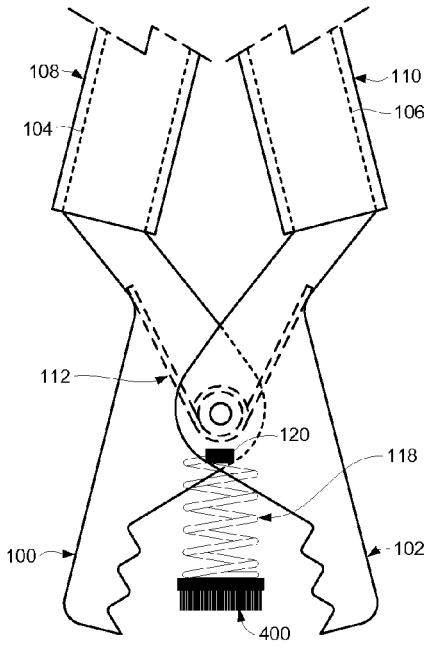
FIG. 4 shows another embodiment of the invention, where a metal brush is further attached to the disk in the longitudinal structure.
Figure 5:
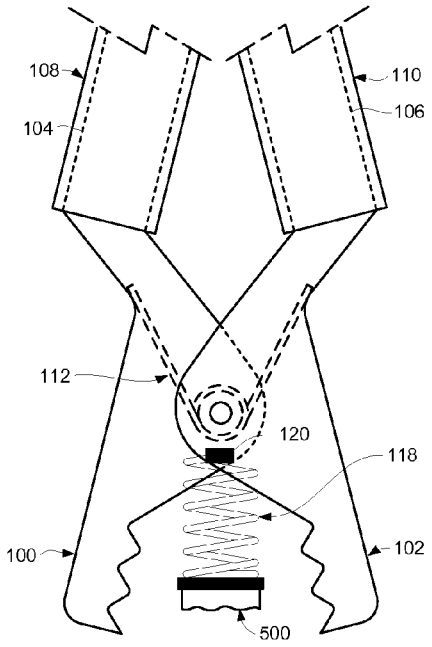
FIG. 5 shows another possible embodiment of the invention, where a compressible conductive material is further attached to the disk in the longitudinal structure.

FIGS. 4 and 5 shows variations to the basic embodiment. In FIG. 4, a wire brush 400 is further attached to the longitudinal member in order to enhance the electrical contact with the battery's terminal. In FIG. 5, a compressible conductive material 500 (such as a wire mesh or a conductive polymer) is attached to the longitudinal member for the same purpose of enhancing the electrical contact with the battery's terminal.

While the invention has been described hereinabove with specific features and embodiments, it will be recognized by those skilled in the art that the clamp just described can be constructed and configured in a wide variety of mechanical shapes and structures, and the invention is intended to encompass all such changes, variations, and alternatives within its scope.

What is claimed is:

1. A clamp for a vehicular battery, comprising:

a) at least two jaws for attaching said clamp to a terminal of said battery; and b) a longitudinal conductive member comprising a straight spring that is placed at a location in between said jaws and electrically connected to said clamp, said longitudinal conductive member constructed and arranged to come into contact with said terminal when the clamp is attached to the terminal.

2. A clamp according to claim 1, wherein the longitudinal conductive member further comprises a metal disk.

3. A clamp according to claim 1, wherein the longitudinal conductive member further comprises a wire brush.

4. A clamp according to claim 1, wherein the longitudinal conductive member further comprises a compressible conductive material, said compressible conductive material is selected from the group consisting of conductive polymers and wire meshes.

5. A clamp according to claim 1, further comprising handles for forcing the jaws of the clamp away from each other.

6. A clamp according to claim 1, further comprising a special spring for forcing the jaws of the clamp toward each other.

7. A clamp according to claim 1, further comprising means for attaching an electrical cable or wire.

8. A clamp for a vehicular battery, comprising:

a) at least two jaws for attaching said clamp to a terminal of said battery; and b) a compressible longitudinal conductive member that is placed at a location in between said jaws and electrically connected to said clamp, said compressible longitudinal conductive member is further attached to a planar metallic surface, wherein said planar metallic surface is constructed and arranged to come into contact with said terminal when the clamp is attached to the terminal.

9. A clamp according to claim 8, wherein the planar metallic surface is further attached to a wire brush.

10. A clamp according to claim 8, wherein the planar metallic surface is further attached to a compressible conductive material, said compressible conductive material is selected from the group consisting of conductive polymers and wire meshes.

11. A clamp according to claim 8, further comprising handles for forcing the jaws of the clamp away from each other.

12. A clamp according to claim 8, further comprising a special spring for forcing the jaws of the clamp toward each other.

13. A clamp according to claim 8, further comprising means for attaching an electrical cable or wire.

* * * * *